US010655398B2

(12) United States Patent
Saini

(10) Patent No.: US 10,655,398 B2
(45) Date of Patent: May 19, 2020

(54) ATTACHMENT OF TSP DIAMOND RING USING BRAZING AND MECHANICAL LOCKING

(71) Applicant: Halliburton Energy Services, Inc., Houston, TX (US)

(72) Inventor: Gagan Saini, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 298 days.

(21) Appl. No.: 15/572,651

(22) PCT Filed: Jun. 26, 2015

(86) PCT No.: PCT/US2015/037941
§ 371 (c)(1),
(2) Date: Nov. 8, 2017

(87) PCT Pub. No.: WO2016/209256
PCT Pub. Date: Dec. 29, 2016

(65) Prior Publication Data

US 2018/0135357 A1 May 17, 2018

(51) Int. Cl.
*E21B 10/573* (2006.01)
*E21B 10/56* (2006.01)
*E21B 10/42* (2006.01)

(52) U.S. Cl.
CPC ..... *E21B 10/573* (2013.01); *E21B 10/42* (2013.01); *E21B 2010/564* (2013.01)

(58) Field of Classification Search
CPC ..... E21B 10/573; E21B 2010/564
See application file for complete search history.

(56) References Cited

U.S. PATENT DOCUMENTS 4,931,363 A 6/1990 Stutz et al.
5,282,513 A 2/1994 Jones
(Continued)

FOREIGN PATENT DOCUMENTS

CN 102859109 A 1/2013
CN 202763302 U 3/2013
(Continued)

OTHER PUBLICATIONS

International Search Report and Written Opinion issued in related PCT Application No. PCT/US2015/037941 dated Mar. 11, 2016, 14 pages.

(Continued)

*Primary Examiner* — Shane Bomar
(74) *Attorney, Agent, or Firm* — Alan Bryson; Baker Botts L.L.P.

(57) ABSTRACT

A cutter for a drill bit and method of manufacturing same is disclosed. The cutter has a non-leached polycrystalline diamond (PCD) table bonded to a substrate and a leached PCD table bonded to one or both of the substrate and non-leached PCD table. The leached PCD table may be ring-shaped and acts as the working surface of the cutting element. It may have a jagged inner surface which cooperates with complementary jagged-shaped outer surface of the non-leached PCD table to prevent rotation of the leached PCD table relative to the non-leached PCD table during a cutting operation. A surface of the leached PCD table may be tapered and fit together in a complementary manner with an oppositely tapered surface of the non-leached PCD table so as to mechanically lock the leached PCD table to the non-leached PCD table.

20 Claims, 8 Drawing Sheets

(56) References Cited

U.S. PATENT DOCUMENTS

| | | | | |
|---|---|---|---|---|
| 5,524,719 | A | 6/1996 | Dennis | |
| 5,957,365 | A | 9/1999 | Anthon | |
| 7,487,849 | B2 | 2/2009 | Radtke | |
| 7,942,219 | B2 | 5/2011 | Keshavan et al. | |
| 8,061,454 | B2 | 11/2011 | Voronin et al. | |
| 8,074,748 | B1 | 12/2011 | Miess et al. | |
| 8,104,464 | B2 | 1/2012 | Sung | |
| 8,360,176 | B2 | 1/2013 | Zhang et al. | |
| 8,697,258 | B2 | 4/2014 | Mirchandani et al. | |
| 8,727,043 | B2 | 5/2014 | Zhang et al. | |
| 8,763,730 | B2 | 7/2014 | Cariveau et al. | |
| 8,800,691 | B2 | 8/2014 | Shen et al. | |
| 8,814,966 | B1 | 8/2014 | Bertagnolli et al. | |
| 8,821,603 | B2 | 9/2014 | Bitler et al. | |
| 10,105,826 | B2 * | 10/2018 | Gledhill | C22C 1/05 |
| 2008/0230279 | A1 | 9/2008 | Bitler et al. | |
| 2009/0032169 | A1 | 2/2009 | Dourfaye et al. | |
| 2012/0037431 | A1 | 2/2012 | DiGiovanni et al. | |
| 2012/0097457 | A1 | 4/2012 | Setlur et al. | |
| 2012/0247841 | A1 | 10/2012 | Tessitore et al. | |
| 2012/0273281 | A1 | 11/2012 | Burhan et al. | |
| 2013/0068539 | A1 | 3/2013 | Vempati et al. | |
| 2013/0168159 | A1 | 7/2013 | Eyre et al. | |
| 2014/0007519 | A1 | 1/2014 | Van Staden et al. | |
| 2014/0069726 | A1 | 3/2014 | Mumma et al. | |
| 2014/0069727 | A1 | 3/2014 | Belnap | |
| 2014/0166371 | A1 * | 6/2014 | Whittaker | B22F 7/08 175/432 |
| 2014/0332286 | A1 * | 11/2014 | Murdock | B24D 3/10 175/432 |
| 2014/0360103 | A1 | 12/2014 | DiGiovanni et al. | |
| 2014/0360791 | A1 | 12/2014 | Bowden et al. | |
| 2014/0373458 | A1 * | 12/2014 | Miess | E21B 10/5673 51/309 |
| 2015/0283618 | A1 * | 10/2015 | DiGiovanni | C22C 26/00 175/434 |
| 2019/0263723 | A1 * | 8/2019 | Kasonde | C04B 35/6303 |

FOREIGN PATENT DOCUMENTS

| | | | |
|---|---|---|---|
| GB | 2438073 | A | 11/2007 |
| WO | 2015076933 | A1 | 5/2015 |

OTHER PUBLICATIONS

Hsieh, Yu-Zan, and Shun-Tian Lin. "Diamond tool bits with iron alloys as the binding matrices." Materials Chemistry and Physics 72.2 (2001): Abstract only, 3 pages.

International Preliminary Report on Patenability issued in related Application No. PCT/US2015/037941, dated Jan. 4, 2018, 11 pages.

Office Action issued in related Chinese application No. 201580078423.8, dated Oct. 16, 2018 (translated).

* cited by examiner

ATTACHMENT OF TSP DIAMOND RING USING BRAZING AND MECHANICAL LOCKING

CROSS-REFERENCE TO RELATED APPLICATION

The present application is a U.S. National Stage Application of International Application No. PCT/US2015/037941 filed Jun. 26, 2015, which is incorporated herein by reference in its entirety for all purposes.

TECHNICAL FIELD

The present disclosure relates generally to drilling tools, such as earth-boring drill bits, and more particularly to attachment of thermally stable polycrystalline (TSP) diamond to a substrate and/or polycrystalline diamond (PCD) surface using brazing and mechanical locking.

BACKGROUND

Various types of drilling tools including, but not limited to, rotary drill bits, reamers, core bits, under reamers, hole openers, stabilizers, and other downhole tools are used to form wellbores in downhole formations. Examples of rotary drill bits include, but are not limited to, fixed-cutter drill bits, drag bits, polycrystalline diamond compact (PDC) drill bits, matrix drill bits, and hybrid bits associated with forming oil and gas wells extending through one or more downhole formations.

Matrix drill bits are typically manufactured by forming a main body having a plurality of blades. Each of the blades may be provided with a plurality of recesses that may be referred to as cutter pockets, each for receiving a respective cutter. The actual cutters are formed of a polycrystalline diamond (PCD) structure (interchangeably referred to as a disc or table), which is attached to a cemented carbide substrate, which is typically formed of a cemented tungsten carbide material. The complete structure of the diamond table together with the substrate to which it is attached may be referred to as a polycrystalline diamond compact ("PDC"), in that such a structure may be formed by compacting in a press at high temperature and pressure. The cutters are attached to the blades of the drill bit main body in the sockets, thereby positioning the cutters at carefully predefined locations and orientations with respect to the bit body for subsequently engaging a formation during use. It is the PCD tables which actually come into contact with, and cut through, the subterranean rock formation being drilled. The mechanical and heat stresses created via the drilling process put a significant strain on the PCD tables as well as the bond between the PCD table and the associated substrate.

Typically, the PCD tables are formed by placing diamond powder into a mold with a cemented carbide substrate and subjecting the mold to a high-pressure, high-temperature (HPHT) press cycle. The metal-solvent catalyst (typically cobalt) from the cemented carbide substrate infiltrates into the polycrystalline diamond to create diamond-to-diamond bonding as well as anchoring of the substrate to the PCD table being formed. A by-product of this process is that some of the metal-solvent catalyst remains in the interstitial spaces formed between the diamond-to-diamond bonds. These residual catalysts can have a detrimental effect on the thermo-mechanical integrity of the cutting element at the working surface since there is coefficient of thermal expansion mismatch between diamond and metal catalyst by an order of magnitude. The PCD table is then typically subjected to acid leaching to remove the metal-solvent catalyst from these interstitial spaces. The leaching process, which generally seeks to remove the metal-solvent catalyst from the entire PCD table, can often take days to weeks to complete

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Various downhole tools formed of a metal-matrix composite (MMC), including drill bits, coring bits, reamers, and/or hole enlargers, may be lowered in a wellbore during a subterranean operation. The cutters secured to these drilling tools experience significant thermo-mechanical stresses and wear/abrasion stresses during the drilling operation. The present disclosure is directed to improving the thermo-mechanical integrity of the cutters of these tools as well as the wear/abrasion resistance and also to minimize the failure of the braze joint between the PCD diamond table and the tungsten carbide substrate, i.e., the PCD table-to-substrate joint. The present disclosure and its advantages are best understood by referring to FIGS. 1 through 5 where like numbers are used to indicate like and corresponding parts.

Figure 1:
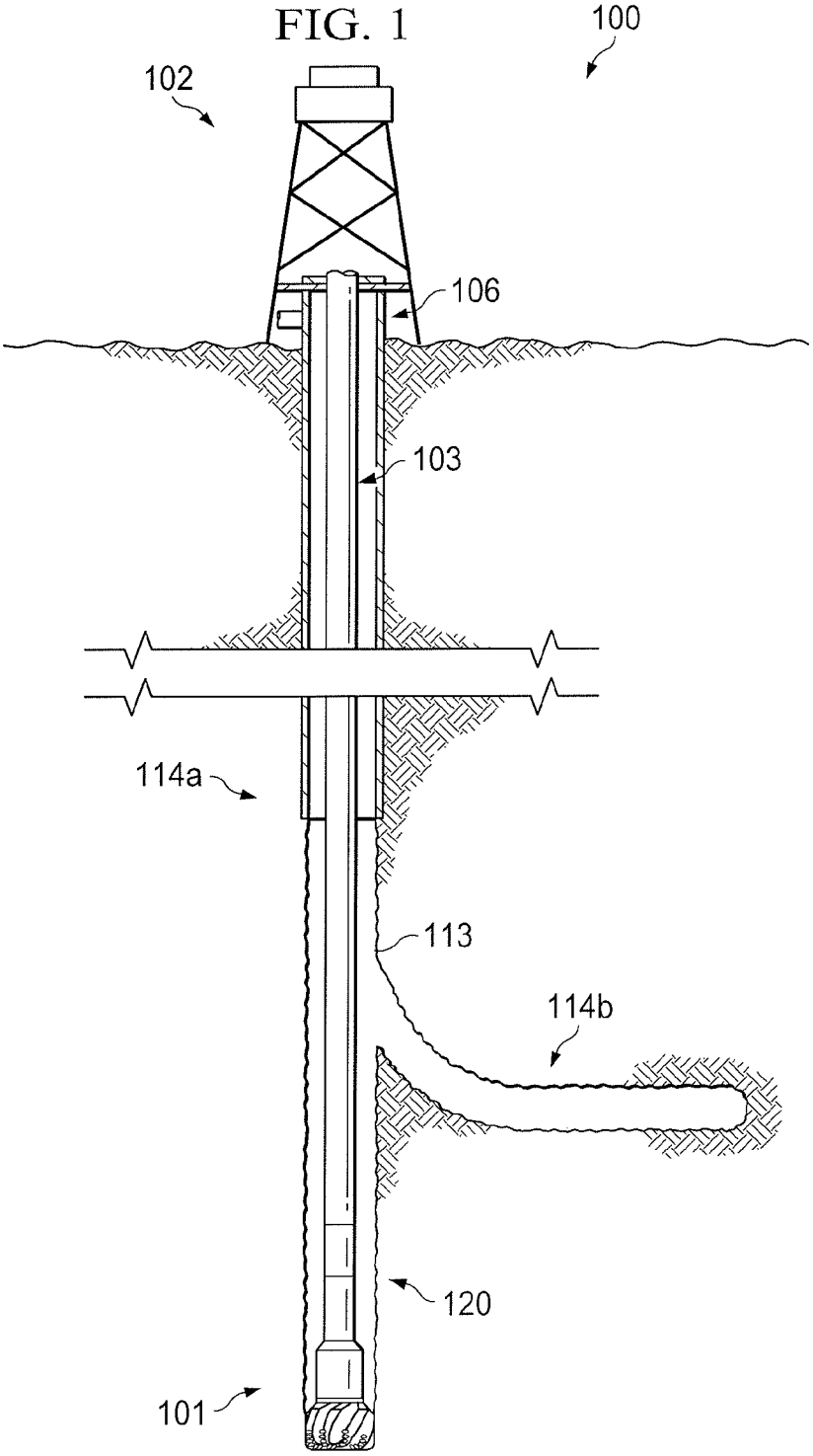
FIG. 1 is an elevation view of a drilling system.

FIG. 1 is an elevation view of a drilling system. Drilling system 100 may include a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles, and/or drilling barges (not expressly shown).

Drilling system 100 may include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom-hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term directional drilling may be used to describe drilling a wellbore or portions of a wellbore that extend at a desired angle or angles relative to vertical. Such angles may be greater than normal variations associated with vertical wellbores. Directional drilling may include horizontal drilling.

Figure 2:
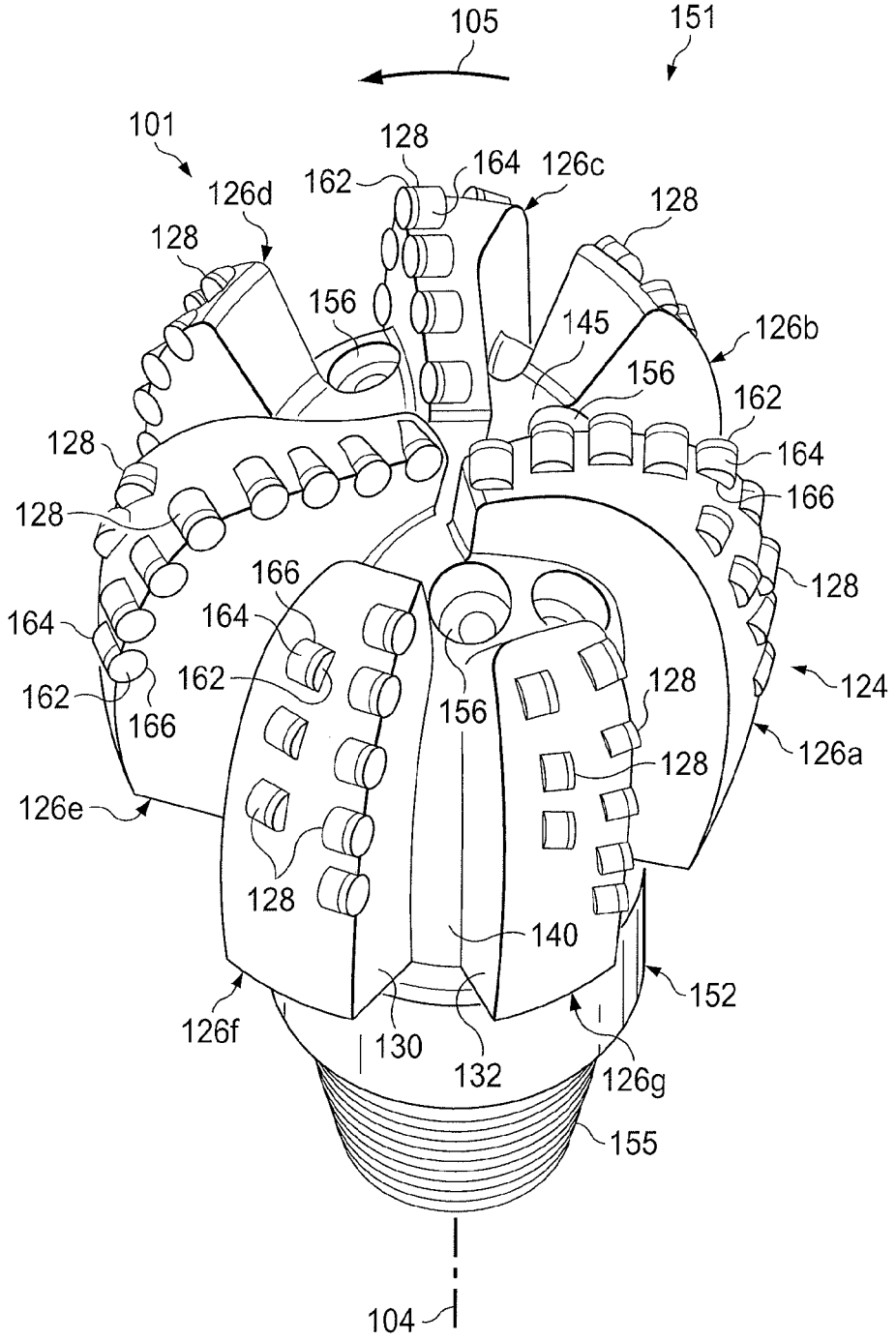
FIG. 2 is an isometric view of a rotary drill bit oriented upwardly in a manner often used to model or design fixed-cutter drill bits.

Drilling system 100 is shown as including a rotary drill bit (drill bit) 101. The cutters made in accordance with the present disclosure are described with reference to drill bit 101. However, as those of ordinary skill in the art will appreciate, the cutters made in accordance with the present disclosure have application to other drilling tools. Turning now to the specifics of drill bit 101 for reference, it may include one or more blades 126 that may be disposed outwardly from exterior portions of rotary bit body 124 of drill bit 101, as shown in FIG. 2. Rotary bit body 124 may be generally cylindrical and blades 126 may be any suitable type of projections extending outwardly from rotary bit body 124. Drill bit 101 may rotate with respect to bit rotational axis 104 in a direction defined by directional arrow 105. Blades 126 may include one or more cutters 128 disposed outwardly from exterior portions of each blade 126, and described in further detail below. Each cutter is formed of a PCD table 162 attached to a substrate 164, which aids in the mounting of the cutters to the blades 126. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

To the extent that at least a portion of the drill bit is formed of an MMC, the drill bit 101 may be any of various types of fixed-cutter drill bits, including PDC bits, drag bits, matrix-body drill bits, steel-body drill bits, hybrid drill bits, and/or combination drill bits including fixed cutters and roller cone bits operable to form wellbore 114 (as illustrated in FIG. 1) extending through one or more downhole formations. Drill bit 101, and in particular the cutters of drill bit 101, may be designed and formed in accordance with teachings of the present disclosure and may have many different designs, configurations, and/or dimensions according to the particular application of drill bit 101.

Drill bit 101 may be an MMC drill bit which may be formed by placing loose reinforcement material, including tungsten carbide powder, into a mold and infiltrating the reinforcement material with a universal binder material, including a copper alloy and/or an aluminum alloy. The mold may be formed by milling a block of material, such as graphite, to define a mold cavity having features that correspond generally with the exterior features of drill bit 101. Various features of drill bit 101 including blades 126, cutter pockets 166, and/or fluid flow passageways may be provided by shaping the mold cavity and/or by positioning temporary displacement materials within interior portions of the mold cavity. A preformed steel shank or bit mandrel (sometimes referred to as a blank) may be placed within the mold cavity to provide reinforcement for bit body 124 and to allow attachment of drill bit 101 with a drill string and/or BHA. A quantity of reinforcement material may be placed within the mold cavity and infiltrated with a molten universal binder material to form bit body 124 after solidification of the universal binder material with the reinforcement material.

Drill bit 101 may include shank 152 with drill pipe threads 155 formed thereon. Threads 155 may be used to releasably engage drill bit 101 with a bottom-hole assembly (BHA), such as BHA 120, shown in FIG. 1, whereby drill bit 101 may be rotated relative to bit rotational axis 104. Plurality of blades 126*a*-126*g* may have respective junk slots or fluid flow paths 140 disposed there between. Drilling fluids may be communicated to one or more nozzles 156.

Drill bit 101 may include one or more blades 126*a*-126*g*, collectively referred to as blades 126 that may be disposed outwardly from exterior portions of rotary bit body 124. Rotary bit body 124 may have a generally cylindrical body and blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126 formed in accordance with the teachings of the present disclosure may have a wide variety of configurations including, but not limited to, substantially arched, helical, spiraling, tapered, converging, diverging, symmetrical, and/or asymmetrical.

Figure 3A:
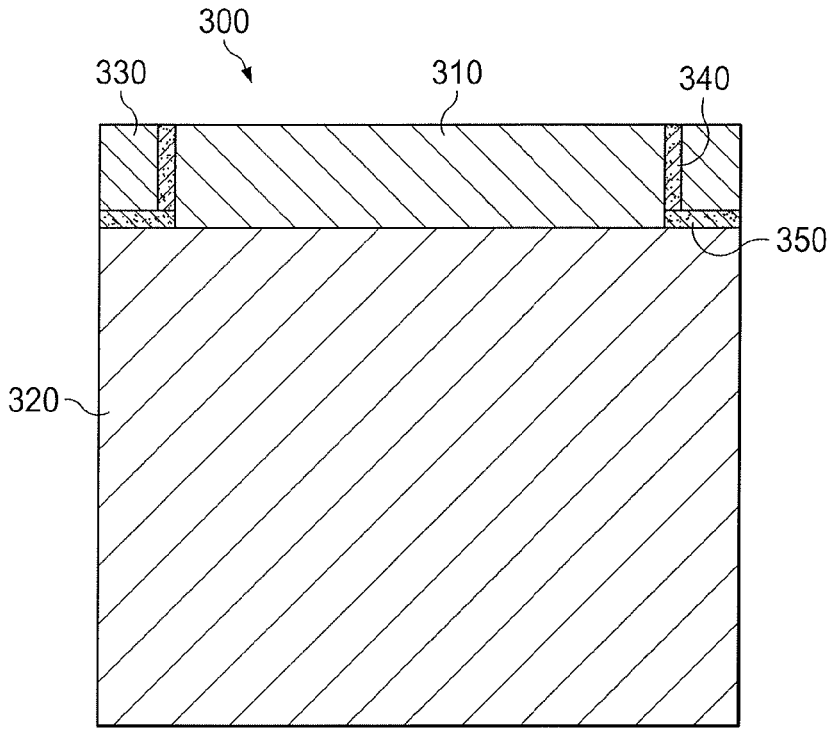
FIGS. 3A and 3B are cross-sectional side and top views, respectively, of a leached PCD ring in accordance with one embodiment of the present disclosure brazed to a non-leached PCD table along an inner surface and brazed to a substrate along one side.
Figure 3B:
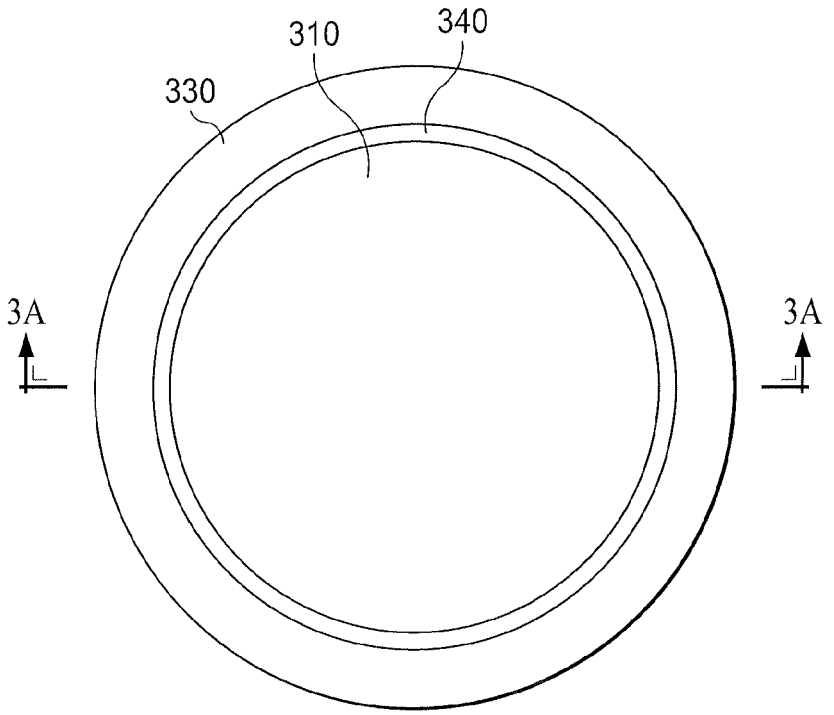

The present disclosure is directed to an improved PDC cutter referred to generally by reference numeral 300 shown in FIGS. 3A and 3B. The PDC cutter 300 includes a PCD table, which itself includes a non-leached, polycrystalline diamond (PCD) table or disc 310. The disc 310 is attached to a substrate 320. The substrate 320 may be formed of a cobalt-cemented tungsten carbide or other suitable material. The non-leached PCD table 310 is bonded to the substrate 320 during a HPHT press cycle. The PDC cutter 300 further includes a TSP diamond ring 330, which may be generally ring-shaped, as shown in the example of FIG. 3A. The PCD ring 330 may be formed by cutting a ring-shaped section of the non-leached PCD table 310 away from an outer region of the PCD table 310 after the HPHT press cycle, e.g., using laser cutting or other suitable technique. Alternatively, the PCD ring 330 may be formed by cutting an outer ring-shaped section of a different non-leached PCD table 310 formed in a separate HPHT press cycle. By forming the PCD ring 330 from an earlier made PCD table, the manufacturing time for making the PDC cutter 300 can be further reduced since the PCD ring 330 can be leached prior to, or simultaneously, with the formation of the PCD table 310. Otherwise, the PCD ring 330 which is cut from the PCD table 310 first has to be leached before it can be re-attached, which still takes significantly less time to complete than conventional methods of forming the leached PDC cutters. More specifically, the time to leach the PCD rings 330 is significantly less than the time it typically takes to leach an entire PCD table 310 or even 100 microns depth of the PCD table 310 because the volume of the PCD ring 330 is significantly smaller than the volume of conventional PCD tables typically being leached. Also, leaching just the PCD rings 330 is quicker because they are not attached to the cement substrate and thus leaching can occur all from all surfaces, instead of one surface as is typically the case. This time savings carries through to the time required to manufacture the PDC cutter 300, because the total time it takes to leach the PCD ring 330 and attach it to a substrate along with the inner non-leached PCD table 310 is significantly less than the time it would take to manufacture conventional PDC cutters leached to a subsequent depths (100 microns or more).

The PCD ring 330 is bonded to the PCD table 310 by brazing the two components together using a braze alloy 340. The PCD ring 330 is bonded to the substrate 320 by brazing the two components together using a second braze alloy 350. The braze alloy 350 may be different than braze alloy 340. The following are examples of braze alloys with their solidus temperature (ST) and liquidus temperature (LT) that may be used:

| Name | Nominal Composition Percent | Liquidus ° C. | Solidus ° C. |
|---|---|---|---|
| Tini-67 ™ | Ti - 67.0<br>Ni - 33.0 | 980 | 942 |
| Ticuni ® | Ti - 70<br>Ni - 15<br>Cu - 15 | 960 | 910 |
| Ticuni-60 ® | Ti - 60<br>Ni - 25<br>Cu - 15 | 940 | 890 |
| Silver-ABA ® | AG - 92.75<br>Cu - 5.0<br>Ai - 1.0<br>Ti - 1.25 | 912 | 860 |
| Ticusil ® | Ag - 68.8<br>Cu - 26.7<br>Ti - 4.5 | 900 | 780 |
| Cusil-ABA ® | Ag - 63.0<br>Cu - 35.25<br>Ti - 1.75 | 815 | 780 |
| Cusin-1-ABA ® | Ag - 63.0<br>Cu - 34.25<br>Sn - 1.0<br>Ti - 1.75 | 805 | 775 |
| Incusil ®-ABA ™ | Ag - 59.0<br>Cu - 27.25<br>In - 12.5<br>Ti - 1.25 | 715 | 605 |

Furthermore, example "active" braze materials that may be used for bonding the PCD rings to the PCD table and substrate include those having the following composition and liquidus temperature (LT) and solidus temperatures (ST), where the composition amounts are provided in the form of weight percentages: 81.25 Au, 18 Ni, 0.75 Ti, LT=960° C., ST=945° C.; 82 Au, 16 Ni, 0.75 Mo, 1.25 V LT=960° C., ST=940° C.; 20.5 Au, 66.5 Ni, 2.1 B, 5.5 Cr, 3.2 Si, 2.2 Fe, LT=971° C., ST=941° C.; 56.55 Ni, 30.5 Pd, 2.45 B, 10.5 Cr, LT=977° C., ST-941° C.; 92.75 Cu, 3 Si, 2 Al, 2.25 Ti, LT=1,024° C., ST=969° C.; 82.3 Ni, 3.2 B, 7 Cr, 4.5 Si, 3 Fe, LT=1,024° C.; ST=969° C.; and 96.4 Au, 3 Ni, 0.6 Ti, LT=1,030° C., ST=1,003° C.

Example "non-active" braze materials that may be used for bonding the PCD rings to the PCD table and substrate include those having the following composition and liquid temperature (LT) and solid temperature (ST), where the composition amounts are provided in the form of weight percentages: 52.5 Cu, 9.5 Ni, 38 Mn, LT=925° C., ST=880° C.; 31 Au, 43.5 Cu, 9.75 Ni, 9.75 Pd, 16 M, LT=949° C., ST=927° C.; 54 Ag, 21 Cu, 25 Pd, LT=950° C., ST=900° C.; 67.5 Cu, 9 Ni, 23.5 Mn, LT=955° C., ST=925° C.; 58.5 Cu, 10 Co, 31.5 Mn, LT=999° C., ST=896° C.; 35 Au, 31.5 Cu, 14 Ni, 10 Pd, 9.5 Mn, LT=1,004° C., ST=971° C.; 25 Su, 37 Cu, 10 Ni, 15 Pd, 13 Mn, LT=1,013 degree C., ST=970° C.; and 35 Au, 62 Cu, 3 Ni, LT=1,030° C., ST=1,000° C.

As noted above, braze materials can be active and react with the polycrystalline material used to form the bond. In an example embodiment, where such an active braze material is used, the braze material can react with the polycrystalline material to form a reaction product therein and/or between it and the adjacent support member. The presence of such reaction product can operate to enhance the thermal and/or mechanical properties of the polycrystalline material. For example, where the braze material includes zirconium or titanium and the polycrystalline material comprises a polycrystalline diamond ultra-hard phase, the zirconium or titanium in the braze material reacts with the carbon in the diamond to form zirconium carbide (ZrC) or titanium carbide (TiC).

The choice of braze alloys will depend on active carbide former (tungsten, molybdenum, titanium, chromium, manganese, yttrium, zirconium, niobium, hafnium, tantalum, vanadium, or any combination, mixture, or alloy thereof), melting temperature (solidus and liquidus temperatures), coefficient of thermal expansion, ductility and corrosion resistance, to name a few of the critical properties. As those of ordinary skill in the art will appreciate, additional parameters may impact the selection of the braze alloy being used to bond the PCD ring 330 to PCD table 310 and PCD ring 330 to substrate 320.

Figure 4A:
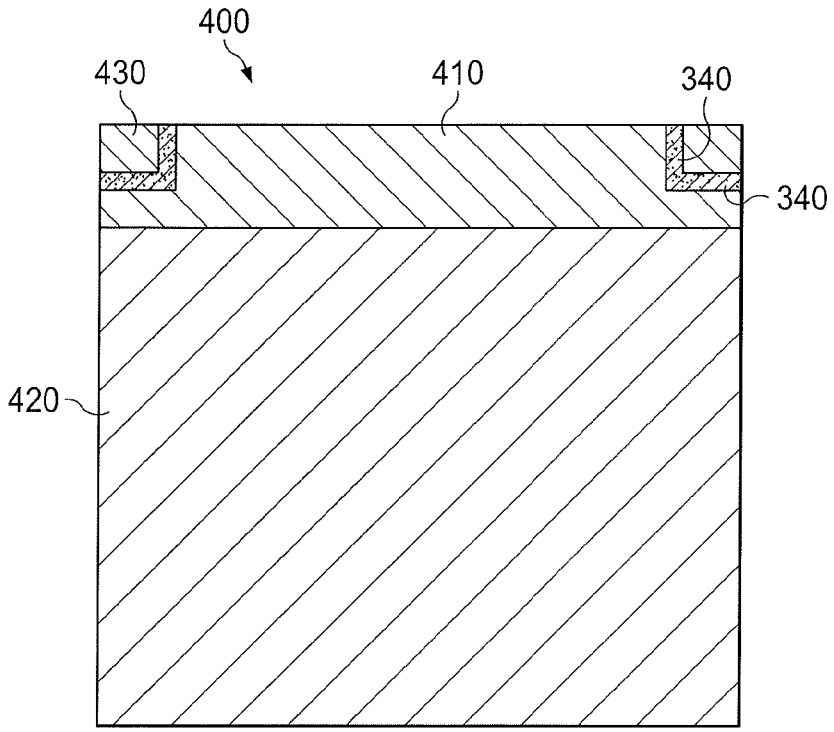
FIGS. 4A and 4B are cross-sectional side and top views, respectively, of an alternate embodiment of the leached PCD ring illustrated in FIGS. 3A and 3B with the ring only being brazed to the non-leached PCD table.
Figure 4B:
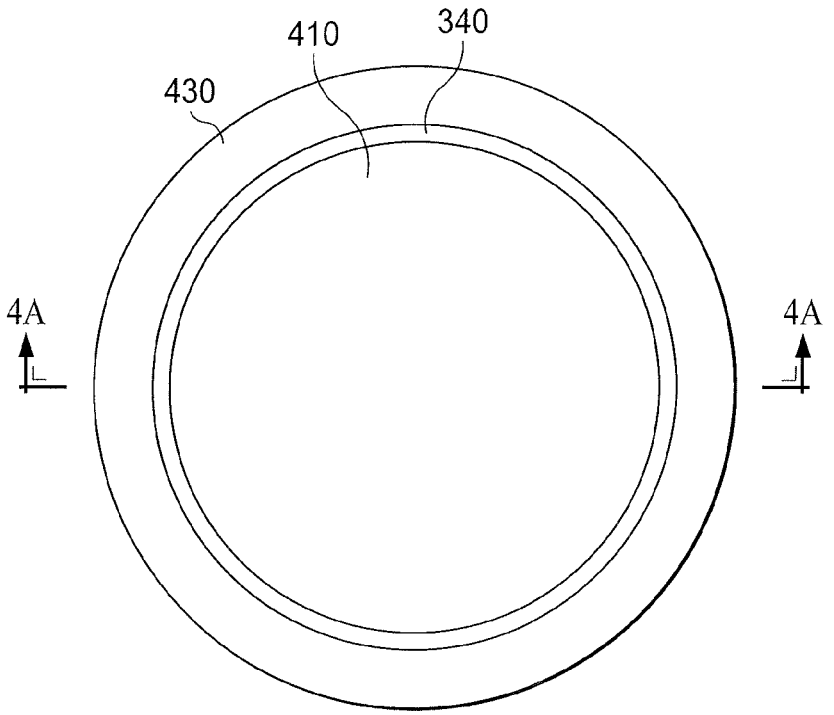

Turning to FIGS. 4A and 4B, the PDC cutter 400 is formed by brazing or bonding leached PCD ring 430 only to non-leach PCD table 410 using braze alloy 340. This embodiment requires a more complex cut to form the PCD ring 430, but avoids the step of bonding the PCD ring 430 to the substrate 420 and associated use of braze alloy 350. Furthermore, as shown in FIG. 4B, the PCD ring 430 in this embodiment is thinner than the PCD ring 330 of FIGS. 3A and 3B and consequently requires even less time to leach. As explained, however, with reference to FIGS. 3A and 3B, the PCD ring 430 may be formed prior to the formation of PCD table 410 to further lessen the time it takes to manufacture PDC cutter 400.

Figure 5A:
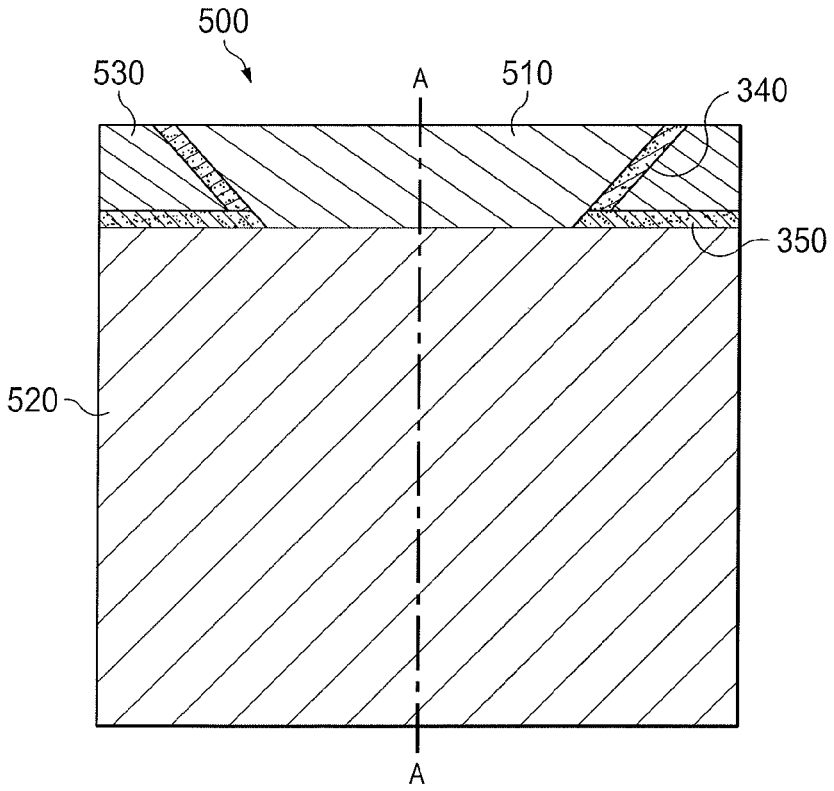
FIGS. 5A and 5B are cross-sectional side and top views, respectively, of another alternate embodiment of the leached PCD ring illustrated in FIGS. 3A and 3B further formed into two separate semi-circular ring segments each having a tapered surface which interlocks with a complementary tapered surface formed on the non-leached PCD table so as to lock the leached PCD ring segments into place axially.
Figure 5B:
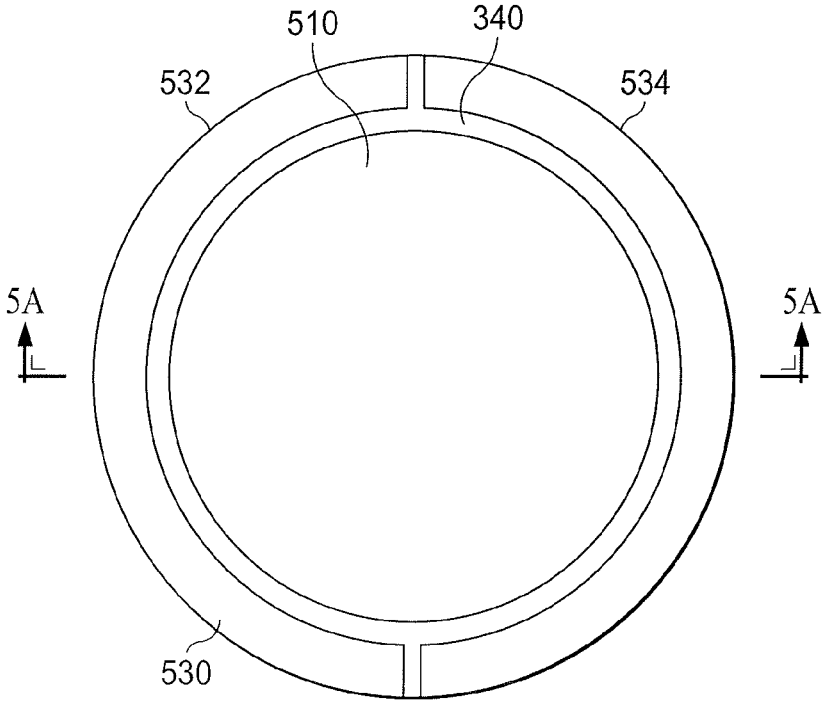

Turning to FIGS. 5A and 5B, the PDC cutter 500 may be formed using a leached PCD ring 530 which is formed into two semi-circular segments 532 and 534. The two semi-circular segments 532 and 534 are brazed or bonded to non-leached PCD table 510 with braze alloy 340 and are bonded to substrate 520 with braze alloy 350. In this embodiment, an inner surface of the semi-circular segments 532 and 534 is formed with a taper, as shown in FIG. 5A. An outer surface of the PCD table 510 is formed with a complementary taper such that when the semi-circular segments 532 and 534 are installed between the PCD table 510 and substrate 520, the segments lock in place thereby preventing them from moving axially along axis A during a downhole drilling operation. The semi-circular segments 532 and 534 are brazed to the PCD table 510 with braze alloy 340 and brazed to the substrate 520 with braze alloy 350. As those of ordinary skill in the art will appreciate more than two segments (3 or 4 or more) may be used. Furthermore, the arcuate segments of this embodiment may be thinner thus only requiring brazing or bonding to the PCD table and not the substrate, such as is the case with the embodiment shown in FIGS. 4A and 4B.

Figure 6A:
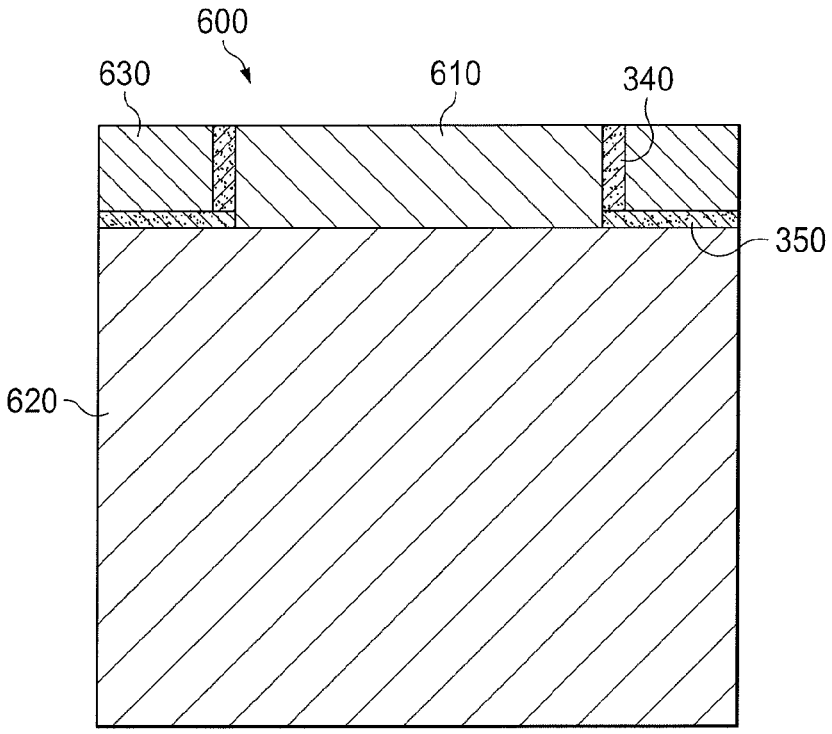
FIGS. 6A and 6B are cross-sectional side and top views, respectively, of another alternate embodiment of the leached PCD ring illustrated in FIGS. 3A and 3B showing the leached PCD ring being formed with a jagged inner surface which interlocks with a complementary jagged outer side surface of the non-leached PCD ring.
Figure 6B:
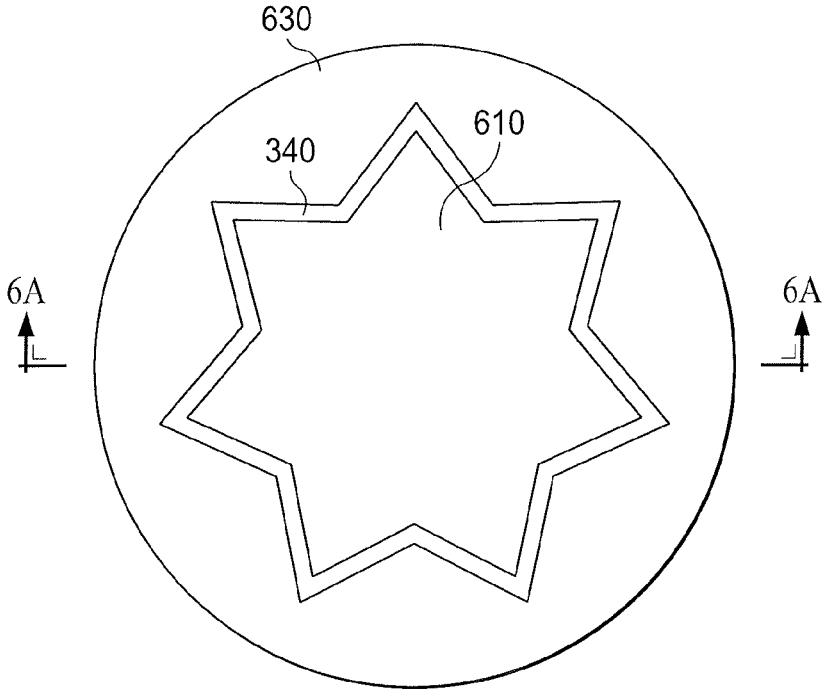

Turning to FIGS. 6A and 6B, the PDC cutter 600 may be formed using leached PCD ring 630 which has a smooth circular outer surface and a jagged inner surface which is brazed to, and interlocks with, a complementary outer surface of non-leached PCD table 610. As those of ordinary skill in the art will appreciate, the jagged inner and outer surfaces of the PCD ring 630 and PCD table 610, respectively, may take many forms and shapes. The 7-pointed star shape shown in FIG. 6B, is just one exemplary configuration. This jagged design prevents the PCD ring 630 from rotating relative to the PCD table 610 under downhole operating conditions. The PCD ring 630 is bonded to PCD table 610 using braze alloy 340. The PCD ring 630 is bonded to substrate 620 using braze alloy 350. As those of ordinary skill in the art will further appreciate, the tapered shape, locking feature illustrated in FIGS. 5A and 5B, and the anti-rotation feature illustrated in FIGS. 6A and 6B may be combined into a single embodiment. Indeed, as those of ordinary skill in the art will appreciate, one or more of the features of the various embodiments disclosed herein may be combined.

Figure 7A:
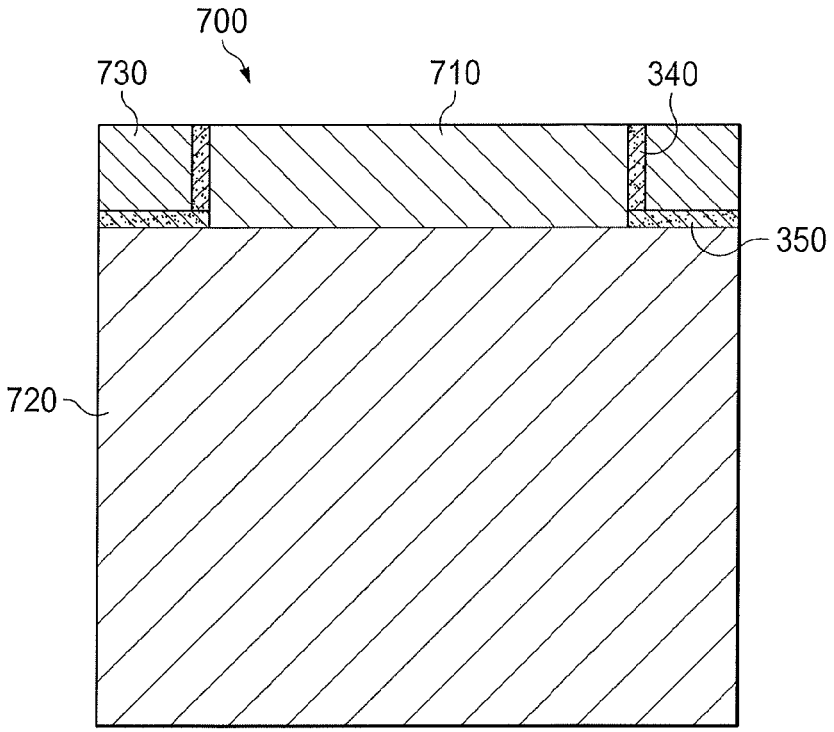
FIGS. 7A and 7B are cross-sectional side and top views, respectively, of another alternate embodiment of the leached PCD ring illustrated in FIGS. 3A and 3B formed into a plurality of arcuate sections.
Figure 7B:
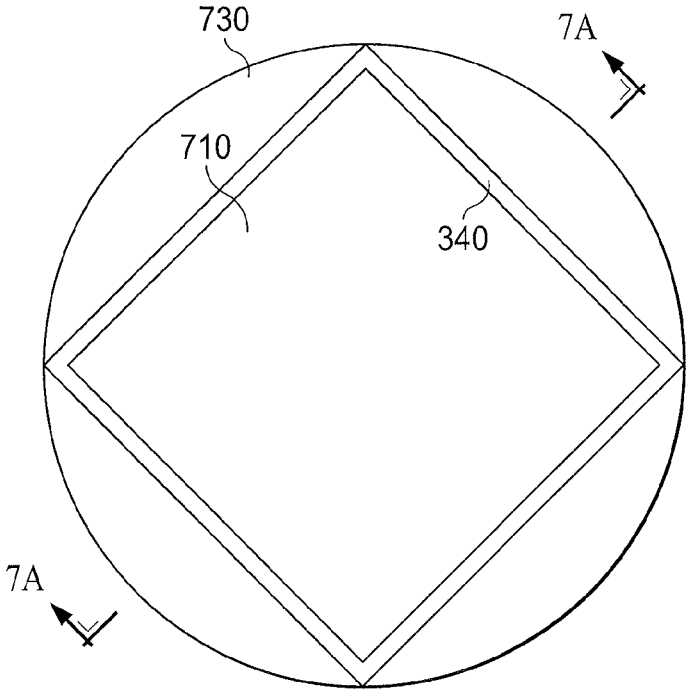

Turning to FIGS. 7A and 7B, the PCD cutter 700 may be formed of leached PCD ring 730 which is formed of a plurality of segments which are arc-shaped on one side and have a straight edge on another side. In the embodiment illustrated in FIG. 7B, PCD ring 730 is formed into 4 arcuate-shaped segments. The four segments are brazed or bonded to non-leached PCD table 710 via braze alloy 340 and bonded to substrate 720 via braze alloy 350. As those of ordinary skill in the art will appreciate, the axial locking and anti-rotation features of FIGS. 5 and 6, may be incorporated into the embodiment of FIG. 7.

Figure 8:
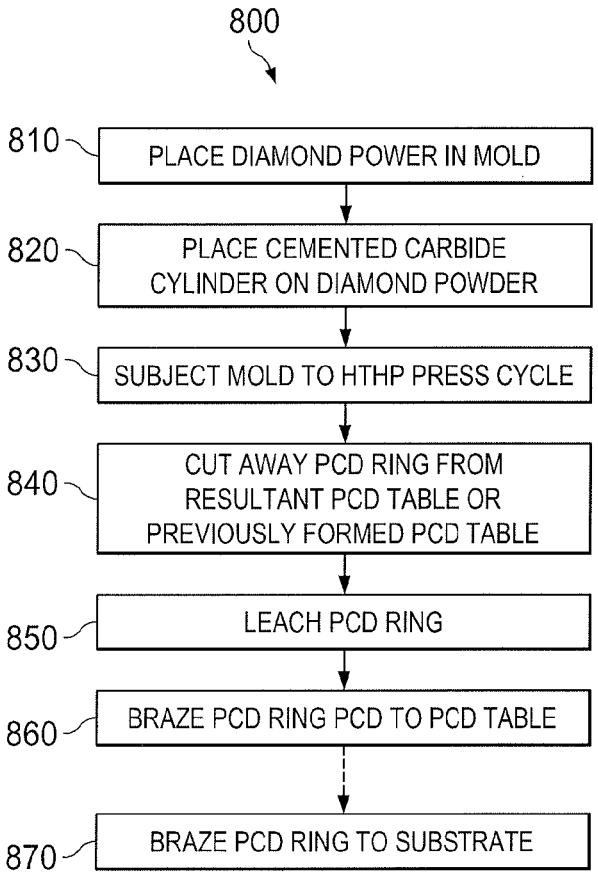
FIG. 8 is a flow chart illustrating a method for forming the PDC cutters in accordance with the present disclosure.

A method referred to generally by reference numeral 800 for forming the PDC cutters in accordance with the present disclosure will now be described with reference to FIG. 8. In a first step 810, diamond powder with either single or multiple grain size distribution is placed in a niobium or zirconium can. In a second step 820, a cemented carbide (e.g., cobalt cemented tungsten carbide) solid cylinder is placed on top of the diamond powder and can is closed for loading into a HTHP press. The metal-solvent catalyst in the substrate acts as the catalyst for the diamond sintering. Optionally, a metal catalyst powder can be separately added by mixing with the diamond powder during the first step. Once in the press, the mold is subjected to a pressure of approximately 4-12 GPa (gigapascals) and a temperature of approximately 1000-1600° C. The details of this HTHP press cycle (step 830 in FIG. 8) are well known in the art and therefore will not be further described herein. The resultant composite formed is a PDC cutter (which is non-leached).

In the next step 840, a PCD ring having one of the configurations described herein is cut away from the non-leached PDC disc. The PCD ring is then subjected to leaching 850. One exemplary method for leaching the PCD ring is to submerge it into an acid bath. In the acid bath, the metal-solvent catalysts, and the other bonding agents (such as boron, tungsten), which aid in the forming of the diamond-to-diamond bonding as well as the bonding of the PCD table to the substrate are removed. The other bonding agents, however, may optionally be left in the PCD table and not leached away. As those of ordinary skill in the art will appreciate, other methods for leaching the PCD table may be utilized.

The resultant leached PCD ring is then bonded to the PCD table via brazing alloy 340 described above in step 860. Dependent upon the particular embodiment, the PCD ring may optionally be bonded to the substrate in step 870. The steps of brazing the PCD ring to the PCD table and the substrate can be performed simultaneously. As explained above, because the PCD ring is much smaller in size than the PCD table which remains, and because it can be leached on all surfaces, it takes much less time to leach. The PCD ring can more easily be attached (or re-attached) to the PDC disc by the brazing techniques discussed above. Furthermore, as also noted above, the PCD ring may be cut from another PDC disc and leached in advance or simultaneous with the forming of the PDC disc to save time in the manufacture of the final resultant PDC cutter. Furthermore, as those of ordinary skill in the art will appreciate, the exact order of some of the steps in the method is not critical and may be altered.

A polycrystalline diamond cutter for use in a drill bit, comprising a substrate, a non-leached polycrystalline diamond (PCD) table bonded to the substrate and a leached polycrystalline diamond (PCD) table bonded to one or both of the substrate and the non-leached PCD table is disclosed. A method of forming a polycrystalline diamond cutter for use in a drill bit, comprising placing a solid substrate into a mold, placing a diamond powder into the mold adjacent the solid substrate, subjecting the diamond power and substrate to an HTHP press cycle so as to form a polycrystalline diamond (PCD) table bonded to the solid substrate and brazing a leached PCD table to one or both of the substrate and the non-leached PCD table is also disclosed.

In any of the embodiments described in this or the preceding paragraph, the leached PCD table may be generally ring shaped. In any of the embodiments described in this or the preceding paragraph, the leached PCD table may have a generally smooth outer surface and a jagged inner surface which interlocks with a complementary-shaped outer surface of the leached PCD table so as to prevent rotation of the leached PCD table relative to the non-leached PCD table during use of the polycrystalline diamond cutter in a drilling operation. In any of the embodiments described in this or the preceding paragraph, the leached PCD table may comprise one or more arcuate-shaped sections which may be arranged into a circular ring or shorter arcuate segment. In any of the embodiments described in this or the preceding paragraph, each arcuate-shaped section may have a taper formed along an inner surface of the arc which engages with an oppositely-formed and complementary tapered outer surface of the leached PCD table so as to retain each arcuate-shaped section between the leached PCD table and the substrate.

In any of the embodiments described in this or the preceding two paragraphs, the leached PCD table may comprise at least one section having an arcuate-shape on one side and a flat surface on an opposite side. In any of the embodiments described in this or the preceding two paragraphs, the leached PCD table may comprise two or more sections (e.g., four sections each comprising a 90° arc), the sections being disposed around the non-leached PCD table in a generally ring shape. In any of the embodiments described in this or the preceding two paragraphs, the leached PCD table may be brazed to the non-leached PCD table using a first braze alloy and may be brazed to the substrate using a second different braze alloy. In any of the embodiments described in this or the preceding two paragraphs, the leached PCD table may be formed by cutting away one of more sections of the non-leached PCD table and leaching those sections. In any of the embodiments described in this or the preceding two paragraphs, the leached PCD table may be formed by cutting away one or more sections of a PCD table different than the non-leached PCD table and leaching those sections.

Use of the techniques disclosed herein enables the TSP ring to be thicker than the leached regions of conventional PCD tables. Because the substrate needs to be masked against leaching, traditional leaching allows the PCD table to be leached to maximum depths of approximately 500-700 microns. By using the TSP ring, depths of 1,000-1,500 microns or more may be achieved. The leaching depth is related to thermal wear performance of the PDC cutter, and performance goes up with increase in leaching depths. Furthermore, use of the TSP ring minimizes the surface area that braze is used and thus minimizes the chance that the entire TSP disc will be destroyed or sheared in the event the braze fails when we use complete TSP discs. By using the TSP ring, should the braze between the substrate and the ring fail, a new TSP ring may be attached without sacrificing the entire PCD cutter. Furthermore, use of TSP ring completely eliminates the need for a second HTHP press cycle for those approaches where TSP diamond discs are first created are then subsequently re-attached to substrate in second HTHP press cycle. Indeed, the TSP ring according to the present disclosure eliminates the need to leach the entire PCD table and subsequent need to re-attach the PCD table to a substrate and the associated time and process control challenges that result from such second HTHP press cycles. Furthermore, attachment of TSP ring to the PCD table improves the impact toughness of the diamond table as a whole since the inner core is still a non-leached PCD table, as compared to brazing TSP diamond disc to WC substrate where the entire disc is leached and thus tends to be brittle.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. As way of a non-limiting example, the edges of the PCD ring shown in FIGS. 3-6, which are illustrated as sharp edges, can alternatively be smooth, contoured, rounded or have some other similar shape. As way of another non-limiting example, the shape of the inner surface of the PCD ring in FIG. 6 and the complementary outer surface of the PCD table may be smooth, contoured, rounded or have some other similar shape. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A polycrystalline diamond cutter for use in a drill bit, comprising:

a substrate;

a non-leached polycrystalline diamond (PCD) table bonded to the substrate;

a leached polycrystalline diamond (PCD) table brazed to both the substrate and the non-leached PCD table and defining a cutting edge of the polycrystalline diamond cutter;

a first braze alloy located between the leached PCD table and the substrate; and a second different braze alloy located between the leached PCD table and the non-leached PCD table.

2. The polycrystalline diamond cutter according to claim 1, wherein the leached PCD table is generally ring shaped and encircles the non-leached PCD table.

3. The polycrystalline diamond cutter according to claim 2, wherein the leached PCD table has a generally smooth curve-shaped outer surface and a jagged inner surface which interlocks with a complementary-shaped outer surface of the non-leached PCD table so as to prevent rotation of the leached PCD table relative to the non-leached PCD table during use of the polycrystalline diamond cutter in a drilling operation.

4. The polycrystalline diamond cutter according to claim 1, wherein the leached PCD table comprises one or more arcuate-shaped sections.

5. The polycrystalline diamond cutter according to claim 4, wherein the one or more arcuate-shaped sections form a ring around the non-leached PCD table.

6. The polycrystalline diamond cutter according to claim 4, wherein each arcuate-shaped section has a taper formed along an inner surface of the arc which engages with an oppositely-formed and complementary tapered outer surface of the non-leached PCD table so as to retain each arcuate-shaped section between the non-leached PCD table and the substrate.

7. The polycrystalline diamond cutter according to claim 1, wherein the leached PCD table comprises two or more arcuate-shaped sections which are arranged into a circular ring, and wherein each arcuate-shaped section has a taper formed along an inner surface of the arc which engages with an oppositely-formed and complementary tapered outer surface of the non-leached PCD table so as to retain each arcuate-shaped section between the non-leached PCD table and the substrate.

8. The polycrystalline diamond cutter according to claim 1, wherein the leached PCD table comprises at least one section having an arcuate-shape on one side and a flat surface on an opposite side.

9. The polycrystalline diamond cutter according to claim 8, wherein the leached PCD table comprises four sections each comprising a 90° arc, the four sections being disposed around the non-leached PCD table in a generally ring shape.

10. The polycrystalline diamond cutter according to claim 1, wherein the leached PCD table has a generally smooth curve-shaped outer surface and a jagged inner surface which interlocks with a complementary-shaped outer surface of the non-leached PCD table so as to prevent rotation of the leached PCD table relative to the non-leached PCD table during use of the polycrystalline diamond cutter in a drilling operation.

11. The polycrystalline diamond cutter according to claim 1, wherein the leached PCD table comprises two semi-circular sections which are arranged into a circular ring, and wherein each semi-circular section has a taper formed along an inner surface of the arc which engages with an oppositely-formed and complementary tapered outer surface of the non-leached PCD table so as to retain each semi-circular section between the non-leached PCD table and the substrate.

12. A method of forming a polycrystalline diamond cutter for use in a drill bit, comprising:

placing a solid substrate into a mold;

placing a diamond powder into the mold adjacent the solid substrate;

subjecting the diamond power and substrate to a HTHP press cycle so as to form a non-leached polycrystalline diamond (PCD) table bonded to the solid substrate; and brazing a leached PCD table to both the substrate and the non-leached PCD table, wherein the leached PCD table is brazed to the non-leached PCD table using at least a first braze alloy and is brazed to the substrate using at least a second different braze alloy.

13. The method according to claim 12, wherein the leached PCD table is formed by cutting away one of more sections of the non-leached PCD table and leaching those sections.

14. The method to claim 12, wherein the leached PCD table is formed by cutting away one or more sections of a PCD table different than the non-leached PCD table and leaching those sections.

15. The method according to claim 12, wherein the leached PCD table is formed into a generally ring shape.

16. The method according to claim 15, wherein the leached PCD table has a generally smooth circular outer surface and a jagged inner surface which interlocks with a complementary-shaped outer surface of the non-leached PCD table so as to prevent rotation of the leached PCD table relative to the non-leached PCD table during use of the polycrystalline diamond cutter in a drilling operation.

17. The method according to claim 15, wherein the leached PCD table is formed into one or more arcuate-shaped sections and wherein each arcuate-shaped section is formed with a taper along an inner surface of the arc which engages with an oppositely-formed and complementary tapered outer surface of the non-leached PCD table so as to retain each arcuate-shaped section between the non-leached PCD table and the substrate.

18. The method according to claim 17, wherein the leached PCD table has a generally smooth outer surface and a jagged inner surface which interlocks with a complementary-shaped outer surface of the non-leached PCD table so as to prevent rotation of the leached PCD table relative to the non-leached PCD table during use of the polycrystalline diamond cutter in a drilling operation.

19. The method according to claim 12, wherein the leached PCD table is formed into four sections each comprising a 90° arc on one side and a flat surface on an opposite side, and further comprising installing the four sections around the non-leached PCD table in a generally ring shape.

20. The method according to claim 12, wherein the leached PCD table has a generally smooth circular outer surface and a jagged inner surface which interlocks with a complementary-shaped outer surface of the non-leached PCD table so as to prevent rotation of the leached PCD table relative to the non-leached PCD table during use of the polycrystalline diamond cutter in a drilling operation.

* * * * *